US009351355B2

(12) United States Patent
Kim

(10) Patent No.: US 9,351,355 B2
(45) Date of Patent: May 24, 2016

(54) ILLUMINATION SYSTEM HAVING COLOR TEMPERATURE CONTROL AND METHOD FOR CONTROLLING THE SAME

(75) Inventor: Jae Jo Kim, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 949 days.

(21) Appl. No.: 13/328,795

(22) Filed: Dec. 16, 2011

(65) Prior Publication Data

US 2012/0086338 A1 Apr. 12, 2012

Related U.S. Application Data

(63) Continuation-in-part of application No. 12/159,677, filed as application No. PCT/KR2006/005790 on Dec. 28, 2006, now Pat. No. 8,282,238.

(30) Foreign Application Priority Data

Dec. 30, 2005 (KR) ..... 10-2005-0135767

(51) Int. Cl.
*H05B 33/08* (2006.01)
*H05B 37/02* (2006.01)

(52) U.S. Cl.
CPC ..... *H05B 33/0815* (2013.01); *H05B 33/0854* (2013.01); *H05B 33/0818* (2013.01); *H05B 33/0872* (2013.01); *H05B 37/02* (2013.01)

(58) Field of Classification Search
USPC ..... 315/247, 185 S, 291, 307–326
See application file for complete search history.

(56) References Cited

U.S. PATENT DOCUMENTS

| | | | | |
|---|---|---|---|---|
| 5,998,925 | A | 12/1999 | Shimizu et al. | |
| 2004/0239243 | A1 | 12/2004 | Roberts et al. | |
| 2005/0242360 | A1 | 11/2005 | Su | |
| 2006/0007108 | A1 | 1/2006 | Utsumi et al. | |
| 2006/0049782 | A1 * | 3/2006 | Vornsand et al. | 315/312 |

(Continued)

FOREIGN PATENT DOCUMENTS

| | | |
|---|---|---|
| JP | 2001-209049 | 8/2001 |
| JP | 2005-317873 | 11/2005 |

(Continued)

OTHER PUBLICATIONS

International Search Report of PCT/KR2006/005790 mailed on Mar. 27, 2007.

(Continued)

*Primary Examiner* — Tuyet Vo
(74) *Attorney, Agent, or Firm* — H.C. Park & Associates, PLC

(57) ABSTRACT

An illumination system includes a power supply unit; and a light emitting apparatus driven by power supplied from the power supply unit. The light emitting apparatus includes: a first light emitting portion and a second light emitting portion configured to be independently driven to emit output light; and a controller configured to control a color temperature or a luminous flux of the output light by controlling operations of the first and second light emitting portions. The controller is configured to control an output color temperature of the output light according to color temperature control data for controlling an output color temperature of the second light emitting portion or control a luminous flux of the output light according to luminous flux control data for controlling an output luminous flux of the first light emitting portion.

13 Claims, 12 Drawing Sheets

(56) References Cited

U.S. PATENT DOCUMENTS

| | | | | |
|---|---|---|---|---|
| 2009/0267523 | A1* | 10/2009 | Phillips | H05B 33/0863 315/152 |
| 2009/0302783 | A1* | 12/2009 | Wang et al. | 315/307 |
| 2009/0303694 | A1* | 12/2009 | Roth | C09K 11/7734 362/84 |
| 2010/0026191 | A1* | 2/2010 | Radermacher et al. | 315/149 |
| 2010/0109557 | A1* | 5/2010 | Bouchard | 315/294 |
| 2010/0244740 | A1* | 9/2010 | Alpert et al. | 315/297 |
| 2011/0043137 | A1* | 2/2011 | Negley | H05B 33/086 315/297 |
| 2013/0154519 | A1* | 6/2013 | Riesebosch | F21K 9/56 315/312 |
| 2015/0342696 | A1* | 12/2015 | Himeno | F21V 9/08 362/231 |
| 2015/0359061 | A1* | 12/2015 | Adler | H05B 33/0848 315/153 |

FOREIGN PATENT DOCUMENTS

| | | |
|---|---|---|
| KR | 10-2000-0036312 | 7/2000 |
| KR | 10-2005-0103624 | 11/2005 |
| TW | I228841 | 3/2005 |

OTHER PUBLICATIONS

Written Opinion of PCT/KR2006/005790 mailed on Mar. 27, 2007.
Non-Final Office Action of U.S. Appl. No. 12/159,677 dated on Nov. 26, 2010.
Final Office Action of U.S. Appl. No. 12/159,677 dated on Jul. 11, 2011.
Chinese Preliminary Notice of the First Office Action dated Dec. 11, 2009.
Non-Final Office Action of U.S. Appl. No. 12/159,677 dated on Feb. 22, 2012.
Notice of Allowance issued on Aug. 3, 2012 in U.S. Appl. No. 12/159,677.

* cited by examiner

ILLUMINATION SYSTEM HAVING COLOR TEMPERATURE CONTROL AND METHOD FOR CONTROLLING THE SAME

CROSS-REFERENCE TO RELATED APPLICATIONS

The present application is a continuation-in-part of application Ser. No. 12/159,677, filed on Jun. 30, 2008, now issued as U.S. Pat. No. 8,282,238, entitled "LIGHT EMITTING APPARATUS", which is the National Stage of International Application No. PCT/KR2006/005790, filed on Dec. 28, 2006, and claims priority from and the benefit of Korean Patent Application No. 10-2005-0135767, filed on Dec. 30, 2005, which are all hereby incorporated by reference for all purpose as if fully set forth herein.

BACKGROUND OF THE INVENTION

1. Field of the Invention

The present invention relates to a light emitting apparatus, and more particularly, to a light emitting apparatus wherein a plurality of light emitting portions are formed in a single package to implement the light with a variety of light emitting intensities and color temperatures.

2. Discussion of the Background

A light emitting diode (LED) is an element in which minority carriers (electrons or holes) are produced using a P-N junction structure of a compound semiconductor and certain light is emitted through recombination of the carriers. The light emitting diode has less electric power consumption and a longer life span of several to several ten times as compared with conventional light bulbs or fluorescent lamps, thereby having reduced electric power consumption and excellent durability. Further, the light emitting diode can be mounted in a narrow space and has strong resistance against vibration. A light emitting apparatus using such a light emitting diode has been used as a display device and a backlight. Recently, studies have been actively conducted to apply the light emitting apparatus for general illumination.

White light emitting diodes have recently appeared in addition to single color light emitting diodes, e.g., red, blue or green light emitting diodes. As a light emitting apparatus using white light emitting diodes is applied to products for vehicle and illumination, demands on the light emitting apparatus has been rapidly increased.

White light can provide various feelings depending on a light source thereof, and such a phenomenon may result from light emitting intensity or color temperature. The color temperature indicates a physical numerical value with respect to color of a light source, and is represented by Kelvin degree (K). As the color temperature rises, the light becomes blue. As the color temperature lowers, the light with strong red-yellow is emitted. In general, the activity of brain and the power of concentration increase as the color temperature rises, while the sensitivity is activated and feeling becomes comfortable as the color temperature lowers. The light emitting intensity and color temperature of such a light source may be appropriately combined to be applied to a desired use. For example, the white light with a high color temperature in a middle degree of the light emitting intensity is desirable in the daytime, in which human beings are mainly active, in order for them to concentrate on their work, and the white light with low color temperature is desirable at night, which is time for rest and sleep, in order for them to feel easy and comfortable. Further, it has been reported that the wavelength and color temperature of light sensitively operates on the growth, activity or the like of plants or animals.

However, since a conventional light emitting apparatus maintains a certain light emitting intensity and color temperature, it is cumbersome that a light emitting apparatus should be individually manufactured depending on its use. In a case where the implementation of light with different color temperatures is required as described above, a plurality of light emitting apparatuses should be manufactured and mounted to be operated. Therefore, there is a disadvantage in that a light emitting apparatus is increased in manufacturing cost and occupies a large mounting space.

SUMMARY OF THE INVENTION

The present invention is conceived to solve the aforementioned problems. An object of the present invention is to provide a light emitting apparatus wherein a plurality of light emitting portions are formed in a single package to implement the light with a variety of light emitting intensities and color temperatures, thereby being applied to a desired environment and use and enhancing the efficiency of spaces and cost.

In order to achieve these objects of the present invention, the present invention provides a light emitting apparatus comprising: a first light emitting portion for emitting white light with a color temperature of 5700K or more; and a second light emitting portion capable of changing the color temperature of the white light emitted from the first light emitting portion, wherein the first and second light emitting portions are independently driven. The light emitting apparatus may further comprise a controller for controlling voltage applied to the first and/or second light emitting portion from the outside. The controller may control the voltage input from the outside in accordance with time and applies it to the first or second light emitting portion.

The first light emitting portion may comprise a blue light emitting diode chip and green and red or yellow light emitting phosphor. The first light emitting portion may comprise an ultraviolet light emitting diode chip and red, green and blue light emitting phosphors.

The second light emitting portion may comprise at least one light emitting diode chip emitting light with a wavelength of 510 to 760 nm. The second light emitting portion may comprise a plurality of light emitting diode chips emitting light with different wavelengths, and the plurality of light emitting diode chips can be selectively driven.

The first and second light emitting portions may be simultaneously driven to have a color temperature in the range of 2800 to 3700K.

In accordance with another embodiment of the present invention, there is provided an illumination system that includes a power supply unit; and a light emitting apparatus driven by power supplied from the power supply unit. The light emitting apparatus includes: a first light emitting portion and a second light emitting portion configured to be independently driven to emit output light; and a controller configured to control a color temperature or a luminous flux of the output light by controlling operations of the first and second light emitting portions. The controller is configured to control an output color temperature of the output light according to color temperature control data for controlling an output color temperature of the second light emitting portion or control a luminous flux of the output light according to luminous flux control data for controlling an output luminous flux of the first light emitting portion.

In accordance with yet another embodiment of the present invention, there is provided an illumination system that includes a power supply unit; a light emitting apparatus driven by a power supplied from the power supply unit; and a user identification unit configured to identify a user. The light emitting apparatus includes: a first light emitting portion and a second light emitting portion configured to be independently driven to emit output light; and a controller configured to control a color temperature or a luminous flux of the output light by controlling operations of the first and second light emitting portions. The controller is configured to control an output color temperature of the output light according to color temperature control data for controlling an output color temperature of the second light emitting portion or control a luminous flux of the output light according to luminous flux control data for controlling an output luminous flux of the first light emitting portion.

In accordance with still another embodiment of the present invention, there is provided a method for controlling illumination system including a first light emitting portion and a second light emitting portion, the method including: storing environment-related control data in an information storage unit; detecting ambient information outside the illumination system; determining a first target value for the illumination system based on the environment-related control data; and controlling the first light emitting portion and the second light emitting portion based on the first target value.

The present invention has an advantage in that a plurality of light emitting portions are formed in a single package to implement white the light with a variety of light emitting intensities and color temperatures, thereby being variously applied to a desired environment and use. Furthermore, there is an effect in that light emitting portions, each of which constitutes a separate package in a prior art, are formed in a single package, thereby reducing the cumbersomeness in a process, enhancing the space efficiency, and reducing the costs.

And, in accordance with the present invention, it is possible to provide an illumination system capable of adjusting light emitting intensities and color temperatures according to ambient environment information or preset information based on user's individual preference. Accordingly, it becomes possible to provide an individual user with optimum illumination, thus maximizing user's satisfaction with the illumination system.

DETAILED DESCRIPTION OF THE ILLUSTRATED EMBODIMENTS

Figure 1:
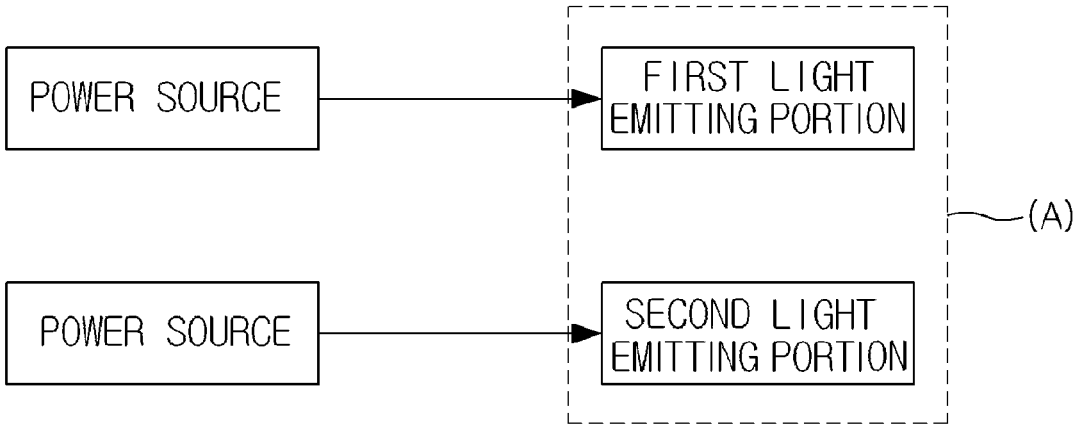
FIG. 1 is a block diagram conceptually illustrating a first embodiment according to the present invention.

Hereinafter, embodiments of the present invention will be described in detail with reference to the accompanying drawings so that the present invention may be readily implemented by those skilled in the art. However, it is to be noted that the present invention is not limited to the embodiments but can be embodied in various other ways. In drawings, parts irrelevant to the description are omitted for the simplicity of explanation, and like reference numerals denote like parts through the whole document.

Through the whole document, the term "connected to" or "coupled to" that is used to designate connection or coupling of one element to another element includes both a case that an element is "directly connected or coupled to" another element and a case that an element is "electronically connected or coupled to" another element via still another element.

Through the whole document, the term "on" that is used to designate a position of one element with respect to another element includes both a case that the one element is adjacent to the another element and a case that any other element exists between these two elements.

Further, the term "comprises or includes" and/or "comprising or including" used in the document means that one or more other components, steps, operation and/or existence or addition of elements are not excluded in addition to the described components, steps, operation and/or elements unless context dictates otherwise. The terms "about or approximately" or "substantially" are intended to have meanings close to numerical values or ranges specified with an allowable error and intended to prevent accurate or absolute numerical values disclosed for understanding of the present invention from being illegally or unfairly used by any unconscionable third party. Through the whole document, the term "step of" does not mean "step for."

Through the whole document, the term "combination of" included in Markush type description means mixture or combination of one or more components, steps, operations and/or elements selected from a group consisting of components, steps, operation and/or elements described in Markush type and thereby means that the disclosure includes one or more components, steps, operations and/or elements selected from the Markush group. In addition, "at least one of X, Y, and Z" may be construed as X only, Y only, Z only, or any combination of two or more of X, Y, and Z, such as, for instance, XYZ, XYY, YZ, and ZZ.

Hereinafter, preferred embodiments of the present invention will be described in detail with reference to the accompanying drawings. However, the present invention is not limited to the embodiments disclosed below but may be implemented into different forms. These embodiments are provided only for illustrative purposes and for full understanding of the scope of the present invention by those skilled in the art. Throughout the drawings, like elements are designated by like reference numerals.

The present invention is characterized in that a first light emitting portion emitting white light with a relatively high color temperature and a second light emitting portion for adjusting color temperature are included in a single package.

FIG. 1 is a block diagram conceptually illustrating a first embodiment according to the present invention.

Referring to FIG. 1, a light emitting apparatus is characterized in that it comprises a first light emitting portion emitting white light with a color temperature of 5700K or more and a second light emitting portion capable of changing the color temperature of the white light emitted from the first light emitting portion, wherein the first and second light emitting portions can be driven independently of each other.

The first light emitting portion emits white light with a color temperature of 5700K or more, i.e., white light known as daylight. To this end, the first light emitting portion may comprise a light emitting diode chip emitting blue light and a phosphor for emitting yellow light. That is, the white light is implemented through the mixture of blue light emitted from the light emitting diode chip and yellow light wavelength-converted by the phosphor.

Further, the first light emitting portion may comprise a light emitting diode chip emitting blue light and phosphors emitting green light and red light. For example, the first light emitting portion may comprise a blue light emitting diode chip, a green light emitting phosphor with a light emitting peak at 515 nm and an orange light emitting phosphor with a light emitting peak at 605 nm. The first light emitting portion implements white light through the mixture of blue light emitted from the light emitting diode chip and green and orange light wavelength-converted by the respective phosphors. There is an advantage in that the light emitting apparatus including such a configuration can obtain a more enhanced color rendering property as compared with the example including the blue light emitting diode chip and the yellow light emitting phosphor.

Further, the first light emitting portion may comprise a light emitting diode chip emitting light in an ultraviolet region and phosphors for emitting red, green and blue light. That is, white light is implemented through the mixture of ultraviolet light emitted from the light emitting diode chip and red, green and blue light wavelength-converted by the phosphor.

The configuration of the light emitting diode chip and the phosphor, which the first light emitting portion comprises, is not limited to the aforementioned examples but may variously formed for the purpose of implementing white light with a color temperature of 5700K or more. Further, the number of light emitting diode chips constituting the first light emitting portion is not limited, but a plurality of the light emitting diode chips may be formed. At this time, the plurality of light emitting diode chips are configured to be respectively and selectively driven, whereby the light emitting intensity of white light can be adjusted.

The second light emitting portion comprises a light emitting diode chip with a light emitting peak at 510 to 760 nm. Such a light emitting diode chip implements various colors of amber, orange, yellow, red and the like. The second light emitting portion may comprise one light emitting diode chip or a plurality of light emitting diode chips. In a case where the second light emitting portion comprises a plurality of light emitting diode chips, the second light emitting portion may comprise light emitting diode chips emitting light with different wavelengths such that the respective light emitting diode chips can be independently driven.

In such a light emitting apparatus, since electrical connection for each of the plurality of light emitting portions is possible in a package A, the first and second light emitting portions can be driven independently. For example, in a case where power is applied only to the first light emitting portion, daylight white light with a color temperature of 5700K or more can be implemented. In a case where power is applied only to the second light emitting portion, green- or red-based light with a light emitting peak at 510 to 760 nm can be implemented. Further, in a case where power is simultaneously applied to both the first and second light emitting portions, white light with low color temperature can be implemented due to the mixture of the white light emitted from the first light emitting portion and the green- or red-based light emitted from the second light emitting portion. That is, warm white light with a color temperature of 2800 to 3700K can be implemented. Accordingly, in the light emitting apparatus of the present embodiment, daylight white light and warm white light can be implemented through the selective operation of the first and second light emitting portions.

In such mixed light of the first and second light emitting portion, the second light emitting portion comprises a plurality of light emitting diode chips such that they can be selectively driven as described above. Accordingly, the color temperature can be more variously adjusted through the combination of the white light emitted from the first light emitting portion and the light with various light emitting wavelengths emitted from the second light emitting portion.

Since such a light emitting apparatus of the present invention can implement white light with various light emitting intensities and color temperatures, there is an advantage in that the light emitting apparatus can be diversely applied to desired atmospheres and uses with the package A. For example, the activity of brain and the power of concentration can be enhanced due to the daylight white light with a color temperature of 5700K or more only by driving the first light emitting portion in the daytime, and an easy and comfortable rest can be taken due to the warm white light with a color temperature of 2800 to 3700K by simultaneously driving the first and second light emitting portions at night.

FIGS. 2 to 5 are schematic sectional views showing examples to which the first embodiment according to the present invention is applied to a variety of structures.

Figure 2:
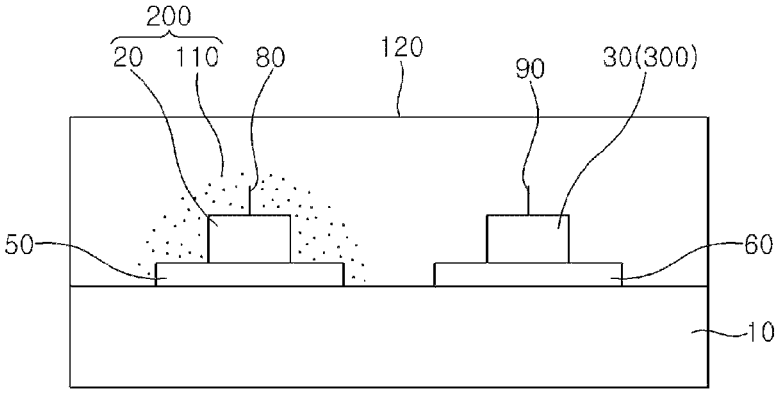
FIGS. 2 to 5 are schematic sectional views showing examples to which the first embodiment according to the present invention is applied to a variety of structures.

Referring to FIG. 2, a light emitting apparatus comprises a substrate 10, electrodes 50 and 60 formed on the substrate 10, a first light emitting portion 200 emitting white light, a second light emitting portion 300 emitting red-based light, and a molding member 120 encapsulating the first and second light emitting portions 200 and 300 on the substrate 10.

The first light emitting portion 200 comprises a first light emitting diode chip 20 emitting blue light and a phosphor 110 for emitting yellow light. Daylight white light with a color temperature of 5700K or more is implemented through the mixture of the blue light emitted from the first light emitting diode chip 20 and the yellow light wavelength-converted by the phosphor 110. Of course, the present invention is not limited thereto but may be formed with various configurations as in the aforementioned embodiment. The phosphor 110, which is in the form mixed in a curable resin, such as epoxy or silicone resin, may be dotted on the first light emitting diode chip 20.

The second light emitting portion 300 comprises a second light emitting diode chip 30 with a light emitting peak at 510 to 760 nm. For example, the second light emitting portion 300 comprises the light emitting diode chip 30 emitting red light.

The first and second light emitting diode chips 20 and 30 are mounted on the first and second electrodes 50 and 60, respectively. Each of the electrodes 50 and 60 may be formed of a metallic material containing Cu or Al with superior conductivity, and formed on the substrate 10 through a printing technique or using an adhesive agent.

Preferably, the first and second electrodes 50 and 60 with the first and second light emitting diode chips 20 and 30 respectively mounted thereon are formed to be insulated from each other in order to independently drive the first and second light emitting portions 200 and 300. The first and second light emitting diode chips 20 and 30 are connected to third and fourth electrodes (not shown) formed corresponding to the first and second electrode 50 and 60 through first and second wires 80 and 90, respectively. Such an electrode pattern is not limited to the aforementioned example but may vary according to the number, configuration and position of the light emitting chips.

Further, the molding member 120 encapsulating the first and second light emitting diode chips 20 and 30 is formed on the substrate 10. The molding member 120 may be formed through an injection process using predetermined transparent epoxy resin. Further, the molding member 120 may be formed by manufacturing its preform using an additional mold and then pressurizing and heat treating it. The molding member 120 may be formed in various shapes such as an optical lens shape, a flat-panel shape and a shape having a predetermined irregularity on its surface.

In such a light emitting apparatus, since electrical connection for each of the plurality of light emitting diode chips 20 and 30 is possible in one package, the first and second light emitting portions 200 and 300 can be independently driven. For example, in a case where a voltage is applied to the first electrode 50 and the third electrode in the first light emitting portion 200, daylight white light with a color temperature of 5700K or more can be implemented. Further, in a case where a voltage is applied to the second electrode 60 and the fourth electrode in the second light emitting portion 300, red light can be implemented. Furthermore, in a case where a voltage is applied simultaneously to the first and second electrodes 50 and 60 and the third and fourth electrodes such that the first and second light emitting portions 200 and 300 are simultaneously driven, warm white light, of which the color temperature lowers, can be implemented due to the mixture of the white light emitted from the first light emitting portion 200 and the red light emitted from the second light emitting portion 300.

As such, the light emitting apparatus according to the present invention has the advantage that daylight white light and warm white light with different color temperatures can be implemented through the selective operating of the first and second light emitting portions 200 and 300. Therefore, according as a light emitting apparatus implementing white light with various color temperatures is manufactured, it can be variously applied in various ways and a multi-functional light emitting apparatus in a package is possible. Further, there is an advantage in that a light emitting apparatus, which included additional packages in a prior art, is formed in the single package, thereby reducing the cumbersomeness in a process, enhancing the space efficiency, and reducing the costs.

Figure 3:
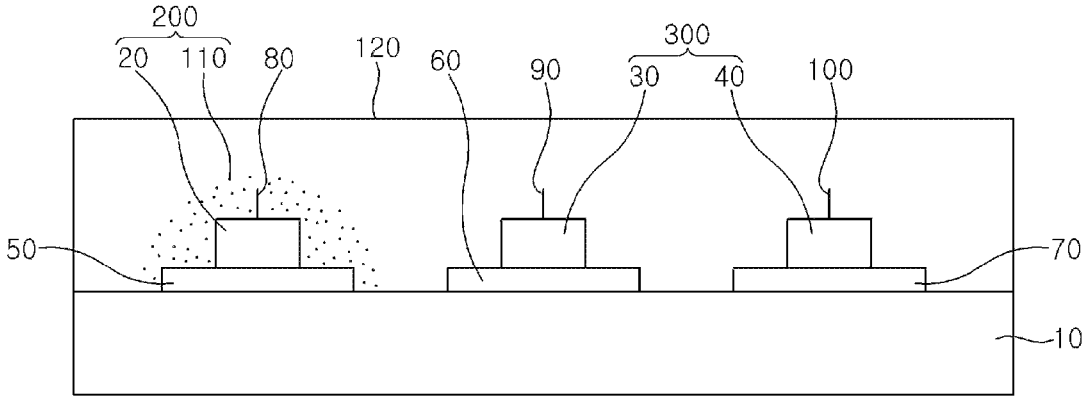

Referring to FIG. 3, a light emitting apparatus comprises a substrate 10, electrodes 50, 60 and 70 formed on the substrate 10, a first light emitting portion 200 emitting white light, a second light emitting portion 300 capable of changing the color temperature of the white light emitted from the first light emitting portion, and a molding member 120 encapsulating the first and second light emitting portions 200 and 300 on the substrate 10. The present light emitting apparatus is almost identical with that of FIG. 2. However, the second light emitting portion 300 of FIG. 3 comprises a plurality of the light emitting diode chips 30 and 40. The detailed descriptions overlapping with those of the previous example will be omitted.

The first light emitting portion 200 comprises a first light emitting diode chip 20 emitting blue light and a phosphor 110 for emitting yellow light, so that daylight white light is implemented through the mixture the blue light emitted from the first light emitting diode chip 20 and the yellow light wavelength-converted by the phosphor 110.

The second light emitting portion 300 comprises the second and third light emitting diode chips 30 and 40, each of which has a light emitting peak at 510 to 760 nm. The second and third light emitting diode chips 30 and 40 may emit the light with the same color or different colors from each other. For example, the second light emitting portion comprises the second light emitting diode chip 30 emitting red light and the third light emitting diode chip 40 emitting green light.

The first, second and third light emitting diodes 20, 30 and 40 are mounted on the first, second and third electrodes 50, 60 and 70, respectively. The second and third light emitting diode chips 30 and 40 of the second light emitting portion 300 may also be formed to be independently driven simultaneously when the first and second light emitting portions 200 and 300 are independently driven. To this end, the first, second and third light emitting diode chips 20, 30 and 40 are mounted on the first, second and third electrodes 50, 60 and 70 formed corresponding thereto, and connected to fourth, fifth and sixth electrodes (not shown) through first, second and third wires 80, 90 and 100, respectively.

In such a light emitting apparatus, since the electrical connection for each of the plurality of light emitting diode chips 20, 30 and 40 is possible in a single package, the first and second light emitting portions 200 and 300 can be independently driven, and the plurality of light emitting diode chips 30 and 40 of the second light emitting portion 300 can also be selectively driven. Accordingly, in a case where the first light emitting portion 200 is driven, daylight white light with a color temperature of 5700K or more can be implemented. In a case where the first and second light emitting portions are simultaneously driven, warm white light, of which the color temperature lowers, can be implemented. Further, there is an advantage in that the selection range of light emitting intensity and color temperature can be more widened as the second and third light emitting diode chips 30 and 40 of the second light emitting portion 300 are selectively driven.

Although the second light emitting portion comprises a plurality of the light emitting diode chips in the aforementioned description, the present invention is not limited thereto. That is, the first light emitting portion may comprise a plurality of the light emitting diode chips. Accordingly, the selection range of light emitting intensity and color temperature can be more widened.

Further, the plurality of light emitting diode chips of the first or second light emitting portion may be variously configured to be connected in serial or parallel in order to be more stably driven.

Figure 4:
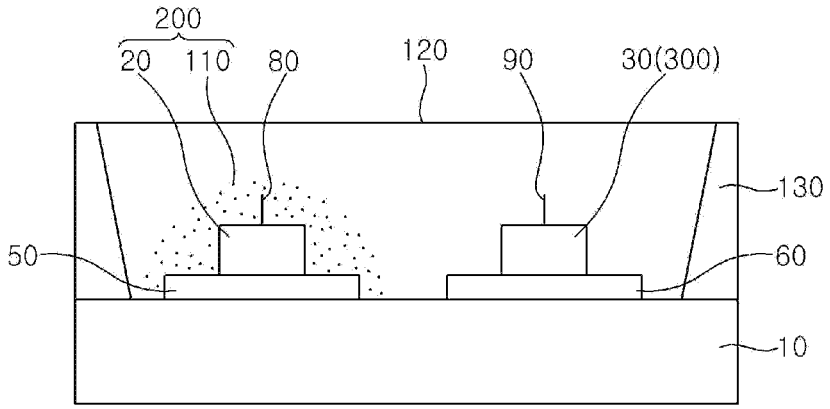

Referring to FIG. 4, an example, which is applied to a top view type structure, is illustrated. A light emitting apparatus comprises a substrate 10, electrodes 50 and 60 formed on the substrate 10, a first light emitting portion 200 emitting white light, and a second light emitting portion 300 emitting red-based light. The present light emitting apparatus is the same as the cases of FIGS. 2 and 3 except that the case of FIG. 4 comprises a reflector 130 formed on the substrate 10 to surround the first and second light emitting portions 200 and 300 and a molding member 120 formed in a central hole of the reflector 130 to encapsulate the first and second light emitting portions 200 and 300. The detailed descriptions overlapping with those of the previous examples will be omitted.

The reflector 130 is formed on the substrate to surround a plurality of light emitting diode chips 20 and 30. At this time, in order to enhance the luminance and the light gathering capability, an inner wall of the reflector 130 surrounding the light emitting diode chips 20 and 30 may be formed to have a certain inclination. This is preferable in order to maximize the reflection of light emitted from the light emitting diode chips 20 and 30 and to enhance the light emitting efficiency.

Figure 5:
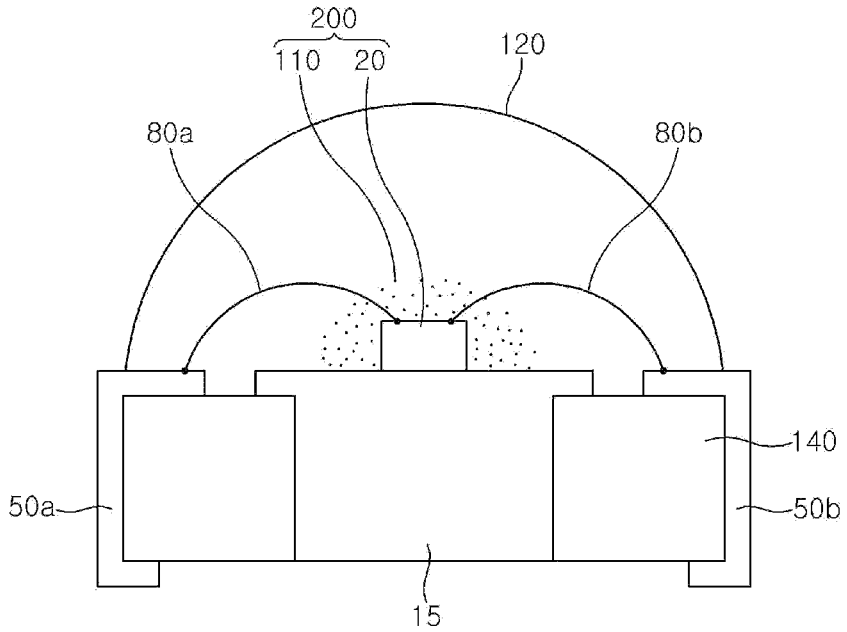

Referring to FIG. 5, a light emitting apparatus comprises a housing 140 with electrodes 50*a* and 50*b* formed at both sides thereof and a through-hole, a substrate 15 mounted in the through-hole of the housing 140, a first light emitting portion 200 mounted on the substrate 15 to emit white light, a second light emitting portion (not shown) emitting red-based light, and a molding member 120 encapsulating the first and second light emitting portions 200. The detailed descriptions overlapping with those of the previous examples will be omitted.

At this time, the substrate 15 is configured as a heat sink using a material with superior thermal conductivity, so that heat diffused from a light emitting diode chip 20 can be more effectively radiated. The substrate may extend to an external heat sink so as to obtain a higher heat radiation effect.

As such, this embodiment may be applied to products with various structures, and for example, formed on a printed circuit board (PCB) or lead terminal.

This embodiment is configured such that it comprise a first light emitting portion emitting white light with a color temperature of 5700K or more and a second emitting red-based light and the first and second light emitting portions can be independently driven.

Further, a light emitting apparatus of the present invention may be formed such that it comprises first and second light emitting portions, and a controller further includes the second light emitting portion so as to control the operation thereof. This will be described below in a following second embodiment. The detailed descriptions overlapping with those of the first embodiment will be omitted.

Figure 6:
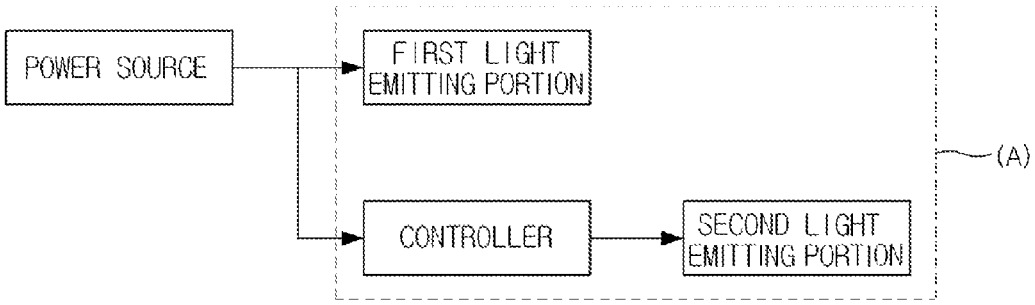
FIG. 6 is a block diagram conceptually illustrating a second embodiment according to the present invention.

FIG. 6 is a block diagram conceptually illustrating the second embodiment according to the present invention.

Referring to FIG. 6, a light emitting apparatus is characterized in that it comprises a first light emitting portion emitting white light with a color temperature of 5700K or more, a second light emitting portion capable of changing the color temperature of the white light emitted from the first light emitting portion, and a controller connected to the second light emitting portion, and the controller controls the voltage applied to the second light emitting portion from the outside.

The first light emitting portion emits white light with a color temperature of 5700K or more, i.e., white light known as daylight. To this end, the first light emitting portion may comprise a light emitting diode chip emitting blue light and a phosphor for emitting yellow light. Further, the first light emitting portion may comprise a light emitting diode chip emitting blue light and a plurality of phosphors for emitting light in a region from green to yellow.

Furthermore, the first light emitting portion may comprise a light emitting diode chip emitting light in an ultraviolet region and phosphors for emitting red, green and blue light.

The second light emitting portion comprises at least one light emitting diode chip with a light emitting peak at 510 to 760 nm.

The controller, which is to control the voltage applied to the second light emitting portion, may comprise a timer and a voltage controller circuit. That is, after controlling the voltage input from an external power source to the controller in accordance with time through the timer and the voltage controller circuit, the controlled voltage is transmitted to the second light emitting portion.

Figure 7:
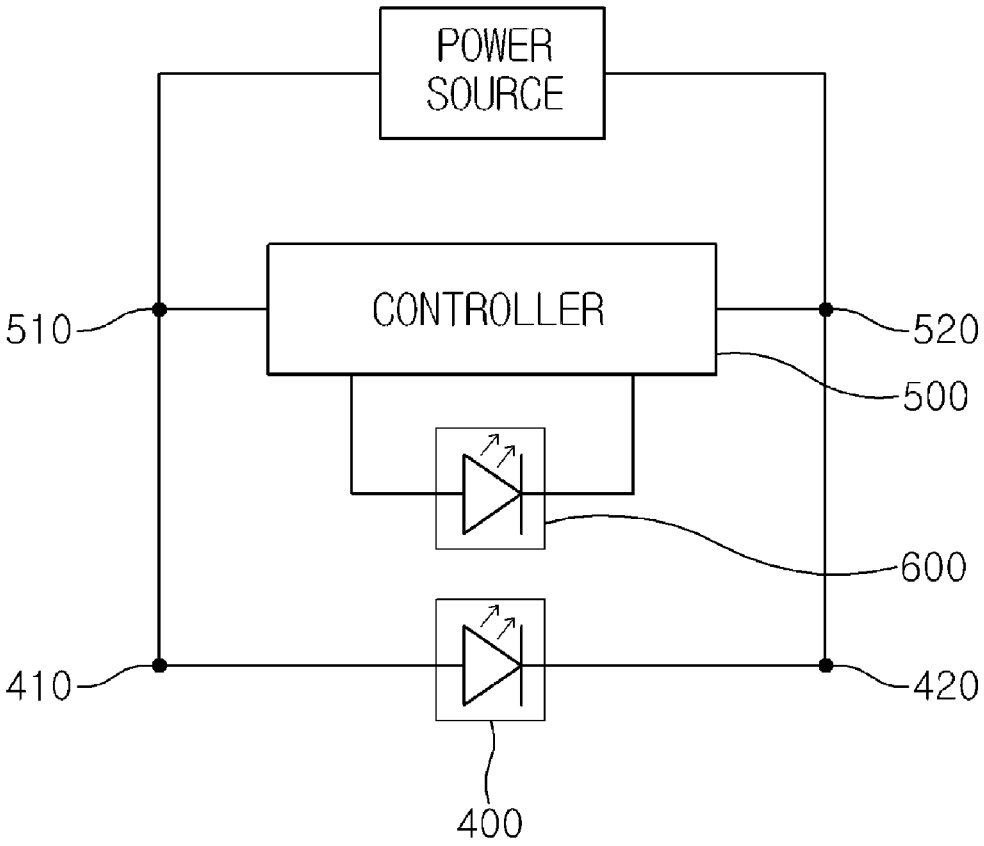
FIG. 7 is a circuit diagram illustrating the second embodiment of the present invention.
Figure 8:
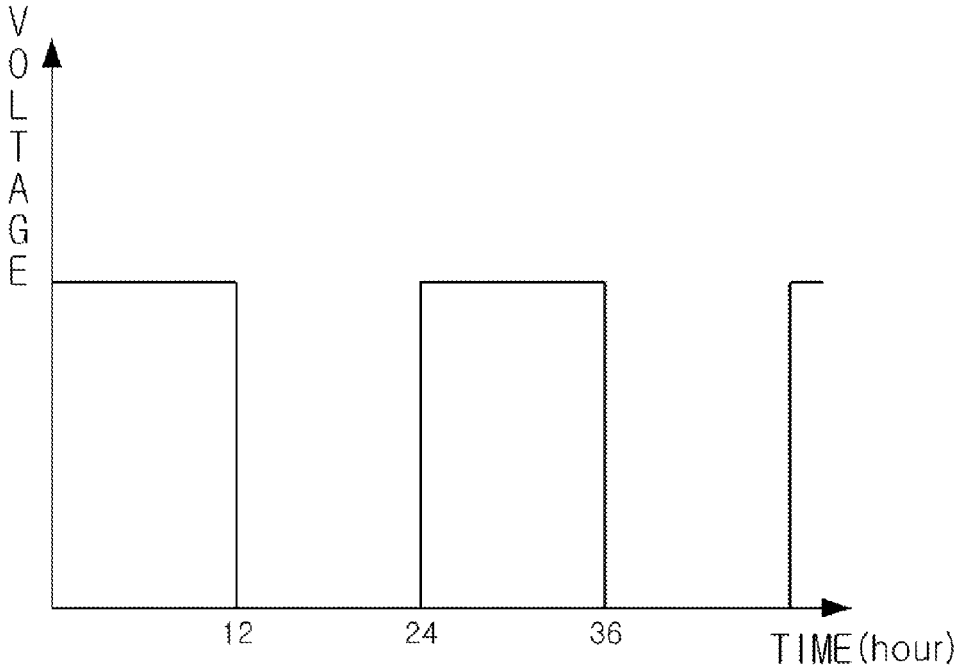
FIG. 8 is a graph illustrating the operation of a controller of the second embodiment according to the present invention.

FIG. 7 is a circuit diagram illustrating the second embodiment of the present invention, and FIG. 8 is a graph illustrating the operation of the controller.

Referring to FIG. 7, the light emitting apparatus comprises a first light emitting portion 400 connected to first and second power connection terminals 410 and 420, a controller 500 connected to third and fourth power connection terminals 510 and 520 to control the voltage input from an external power source, and a second light emitting portion 600 connected to the controller 500. The first, second, third and fourth power connection terminals 410, 420, 510 and 520 are connected to the external power source.

The controller 500 is to control the voltage applied to the second light emitting portion 600. For example, as shown in FIG. 8, the controller 500 controls the voltage input from the outside in accordance with time and outputs the voltage. Referring to FIG. 8, the controller transmits the voltage input from the external power source for 12 hours. Thereafter, the controller allows no voltage to be applied for next 12 hours. That is, the controller transmits the external voltage to the second light emitting portion 600 for 12 hours a day to drive it, and then, allows the external voltage not to be applied to the second light emitting portion 600 for next 12 hours thus not driving it.

The operation of such a light emitting apparatus will be discussed below. The external power is applied to the first light emitting portion 400 and the controller 500, so that the first light emitting portion 400 emits daylight white light with a color temperature of 5700K or more. The controller 500 also controls the voltage in accordance with time to apply it to the second light emitting portion 600, i.e., as described above, the controller can transmit the voltage applied from the outside to the second light emitting portion 600 for 12 hours a day to drive it and then allow the voltage applied from the outside not to be applied to the second light emitting portion 600 for next 12 hours thus not driving it. That is, warm white light with low color temperature can be implemented for 12 hours a day, e.g., at night, due to the mixture of the white light emitted from the first light emitting portion 400 and the red light emitted from the second light emitting portion 600. Thereafter, the power is applied only to the first light emitting portion 400 for next 12 hours, e.g., in the daytime, so that daylight white light with a color temperature of 5700K or more can be implemented.

Although on/off control of the power applied to the second light emitting portion 600 has been described as an example in the foregoing, the present invention is not limited thereto but a variety of controls may be applied. For example, the light emitting intensity of the second light emitting portion 600 can be increased or decreased by increasing or decreasing the voltage in accordance with time. Accordingly, the light emitting apparatus may be formed such that the color temperature of the white light emitted from the light emitting apparatus gradually rises or lowers.

Since such a light emitting apparatus can control the operation of the second light emitting portion through the controller, the operation of the first and second light emitting portions can be variously applied as desired. That is, it is possible to manufacture a light emitting apparatus, in which color temperature is automatically adjusted in accordance with time without an additional input. For example, a light emitting apparatus can be formed to implement daylight white light in the daytime and warm white light at night as described above.

Although the controller to control a voltage in accordance with time has been described in the aforementioned example, the present invention is not limited thereto, but the controller may further comprise an additional input unit in order for color temperature to be adjusted as a user desires. Further, although the example, in which an external voltage is simultaneously applied to the first light emitting portion and the controller, has been described, the present invention is not limited thereto. That is, it will be apparent that the first light emitting apparatus and the controller may be respectively connected to external power sources to be independently driven.

Further, in the present invention, a controller may be formed in each of the first and second light emitting portions. This will be described below in the following third embodiment. The detailed descriptions overlapping with those of the first and second embodiments will be omitted.

Figure 9:
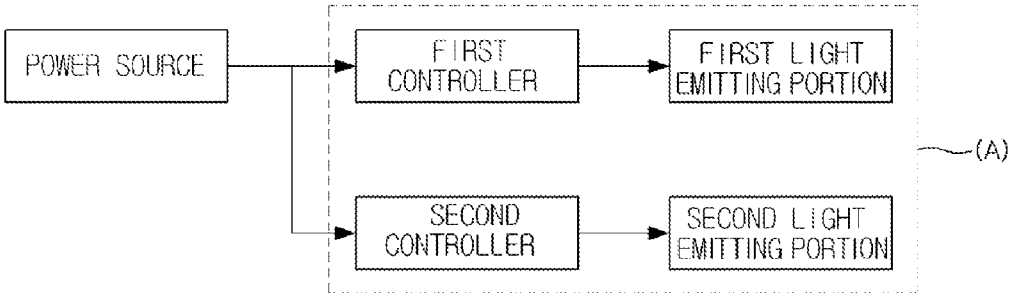
FIG. 9 is a block diagram conceptually illustrating a third embodiment according to the present invention.

FIG. 9 is a block diagram conceptually illustrating the third embodiment according to the present invention.

Referring to FIG. 9, a light emitting apparatus comprises a first light emitting portion emitting white light with a color temperature of 5700K or more, a second light emitting portion emitting red-based light, a first controller connected to the first light emitting portion, and a second controller connected to the second light emitting portion.

The first controller can control the voltage applied to the first light emitting portion, and the second controller can control the voltage applied to the second light emitting portion. Accordingly, the light emitting intensity of the first light emitting portion can be adjusted, and simultaneously, the light emitting intensity of the second light emitting portion can also be adjusted. Thus, a light emitting apparatus implementing white light with various light emitting intensities and color temperatures can be manufactured.

The first or second controller comprises a timer and a voltage controller circuit, so that the voltage can be controlled in accordance with time. Further, there is provided an additional input unit, so that the light emitting intensity and color temperature can be adjusted as a user desires. Although the example, in which the external power is simultaneously applied to the first and second controllers, has been described, the present invention is not limited thereto. It will be apparent that the first and second controllers may be respectively connected to external power sources to be independently driven. Further, the light emitting apparatus may comprise only one controller capable of simultaneously controlling the first and second light emitting portions.

Thus, according as the light emitting apparatus implementing white light with various color temperatures is manufactured, it can be variously applied in various ways and a multifunctional light emitting apparatus in a package is possible. Further, there is an advantage in that a light emitting apparatus, which included additional packages in a prior art, is formed in the single package, thereby reducing the cumbersomeness in a process, enhancing the space efficiency, and reducing the costs.

Although the present invention has been described in connection with the preferred embodiments, it will be understood by those skilled in the art that various modifications and changes can be made thereto without departing from the spirit and scope of the invention defined by the appended claims.

According as the light emitting apparatus implementing white light with various color temperatures is manufactured, it can be variously applied in various ways and a multifunctional light emitting apparatus in a package is possible. Further, there is an advantage in that a light emitting apparatus, which included additional packages in a prior art, is formed in the single package, thereby reducing the cumbersomeness in a process, enhancing the space efficiency, and reducing the costs.

Figure 10:
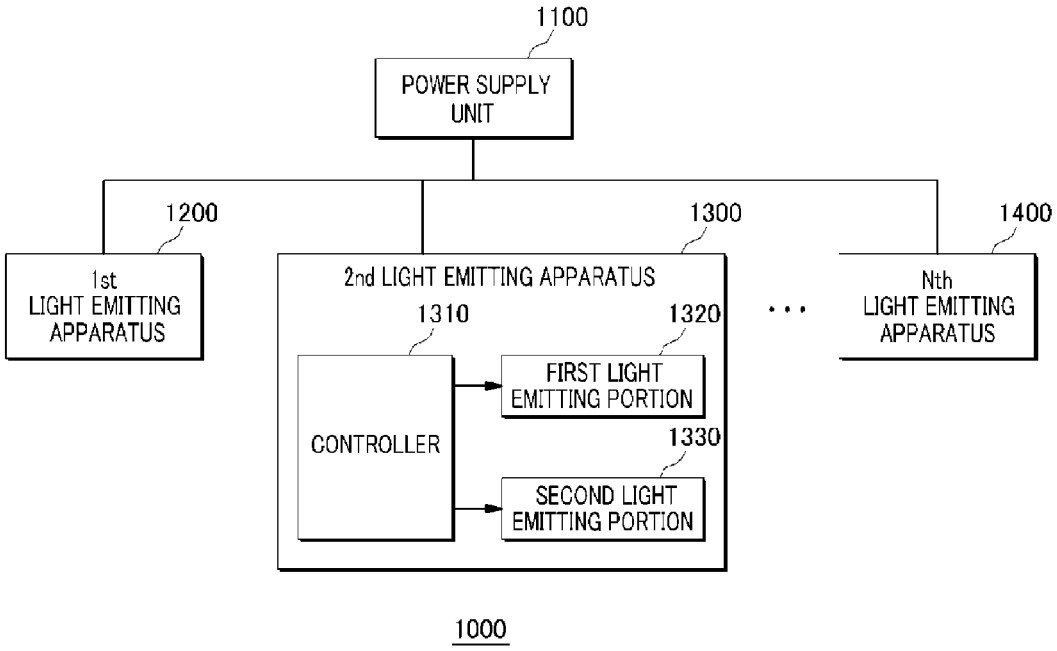
FIG. 10 is a diagram illustrating an illumination system in accordance with a fourth embodiment of the present invention.
Figure 11:
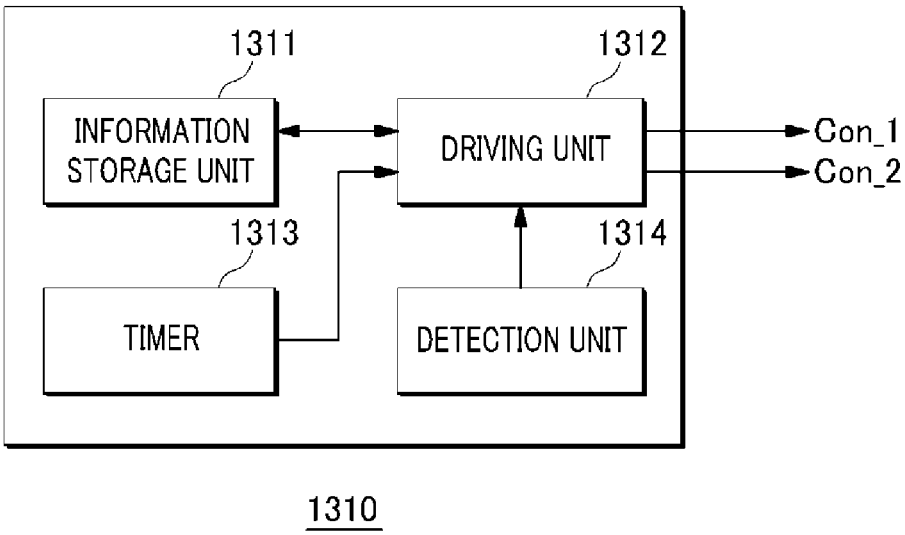
FIG. 11 is a diagram illustrating a detailed configuration of a controller included in the illumination system in accordance with the fourth embodiment of the present invention.

FIG. 10 is a diagram illustrating an illumination system in accordance with a fourth embodiment of the present invention. FIG. 11 is a diagram illustrating a detailed configuration of a controller included in the illumination system in accordance with the fourth embodiment.

An illumination system 1000 may include a power supply unit 1100 and one or more light emitting apparatuses 1200, 1300 and 1400. The illumination system 1000 supplies driving power to the light emitting apparatuses 1200, 1300 and 1400 by the power supply unit 1100. In the illumination system in accordance with the exemplary embodiment of the present invention, the light emitting apparatuses 1200, 1300 and 1400 are independently driven. In order to provide an optimum color temperature or output intensity, a light emitting state of each of the light emitting apparatuses 1200, 1300 and 1400 may be adjusted based on various types of environment information such as driving time, luminous flux, color temperature, temperature, humidity or motion information in the ambient environment.

The power supply unit 1100 may be implemented by various types of power sources such as a battery, a secondary battery and a solar cell as well as by a power source configured to supply power from the outside via a power distribution system.

Here, since the light emitting apparatuses 1200, 1300 and 1400 have the same configuration, only the configuration of the light emitting apparatus 1300 will be described below to avoid redundant description. The light emitting apparatus 1300 may include a controller 1310, a first light emitting portion 1320 and a second light emitting portion 1330.

The first light emitting portion 1320 may emit white light with a color temperature equal to or higher than a certain degree. To this end, the first light emitting portion 1320 may include a light emitting diode and a phosphor. A detailed configuration of this first light emitting portion 1320 may be the same as described in FIGS. 1 to 5.

The second light emitting portion 1330 may emit light having a wavelength within a certain range. The second light emitting portion 1330 may include at least one light emitting diode chip. A color temperature or a luminous flux of the output light can be adjusted by the light emitting diode chip. A detailed configuration of this second light emitting portion 1320 may be the same as described in FIGS. 1 to 5.

The controller 1310 controls the color temperature or the luminous flux of the output light outputted from the first and second light emitting portions 1320 and 1330 by controlling the operations of the first and second light emitting portions 1320 and 1330. For this purpose, the controller 1310 may detect ambient environment information and control the color temperature or the luminous flux of the output light based on preset environment information.

FIG. 11 illustrates a detailed configuration of the controller 1310. The controller 1310 may include an information storage unit 1311, a driving unit 1312, a timer 1313 and a detection unit 1314.

The information storage unit 1311 stores therein color temperature control data including color temperature information and/or luminous flux control data including luminous flux information. The color temperature information and the luminous flux information may be set in advance based on the ambient environment information.

By way of example, the luminous flux control data may include time-based luminous flux control data to designate the output luminous flux of each light emitting apparatus set in advance for each time band. The color temperature control data may include time-based color temperature control data to designate the output color temperature of each light emitting apparatus set in advance for each time band.

Further, the luminous flux control data may include luminous flux-based luminous flux control data to designate an output luminous flux of each light emitting apparatus set in advance based on an outside luminous flux. The color temperature control data may include luminous flux-based color temperature control data to designate an output color temperature of each light emitting apparatus set in advance based on the outside luminous flux.

Further, the luminous flux control data may include color-temperature-based luminous flux control data to designate an output luminous flux of each light emitting apparatus set in advance based on an outside color temperature. The color temperature control data may include color-temperature-based color temperature control data to designate an output color temperature of each light emitting apparatus set in advance based on the outside color temperature.

Furthermore, the luminous flux control data may include temperature-based luminous flux control data to designate an output luminous flux of each light emitting apparatus set in advance based on an outside temperature. The color temperature control data may include temperature-based color temperature control data to designate an output color temperature of each light emitting apparatus set in advance based on the outside temperature.

Moreover, the luminous flux control data may include humidity-based luminous flux control data to designate an output luminous flux of each light emitting apparatus set in advance based on an outside humidity. The color temperature control data may include humidity-based color temperature control data to designate an output color temperature of each light emitting apparatus set in advance based on the outside humidity.

Further, the luminous flux control data may include motion-based luminous flux control data to designate an output luminous flux of each light emitting apparatus set in advance based on the degree of motion of an outside object. The color temperature control data may include motion-based color temperature control data to designate an output color temperature of each light emitting apparatus set in advance based on a degree of motion of the outside object.

The detection unit 1314 may detect the outside luminous flux, the outside color temperature, the outside temperature, the outside humidity or the motion information of the outside object by using a light sensor, a temperature sensor, a humidity sensor or a motion sensor. For example, through the detection unit 1314, it may be possible to detect a change in conditions in the ambient environment such as summertime/wintertime, daytime/nighttime, clear weather/cloudy weather and humid air/dry air. Further, it may be also possible to detect the number of users acting in the area in which the illumination system is installed or to detect the degree of motions of the users.

The timer 1313 may generate absolute time information to be used as a reference for the operations of the other components. The timer 1313 may send the generated absolute time information to the driving unit 1312.

The driving unit 1312 may generate a first control signal (Con_1) to control an operation of the first light emitting portion 1320 or a second control signal (Con_2) to control an operation of the second light emitting portion 1330 based on at least one of the time information collected by the timer 1313 and the luminous flux information, the color temperature information, the temperature information, the humidity information and the motion information detected by the detection unit 1314 and at least one control data stored in the information storage unit 1311.

By way of example, the driving unit 1312 may read out, from the information storage unit 1311, the luminous flux information and the color temperature information corresponding to current time information collected by the timer 1313 and, then, generate the first control signal and the second control signal so as to adjust the output luminous flux through the first light emitting portion 1320 and to adjust the color temperature through the second light emitting portion 1330.

Likewise, after the outside luminous flux, the outside color temperature, the outside temperature, the outside humidity or the outside motion information is detected, the driving unit 1312 may compare the detected information with the information stored in the information storage unit 1311 and, then, generate the first control signal and the second control signal so as to output a luminous flux and a color temperature corresponding to the current environment information.

By way of example, during the daytime in summer, the color temperature of light emitted from the light emitting apparatus 1300 may be increased, thus allowing the user to feel cool. Further, in case that the light emitting apparatus 1300 is located adjacent to a window through which sunlight enters, the amount of the light emitted from the light emitting apparatus 1300 may be reduced in consideration of the amount of the sunlight. Further, it may be also possible to maintain the color temperature of the light from the light emitting apparatus 1300 at a level corresponding to reference color temperature data in consideration of the color temperature of the sunlight. Moreover, it may be also possible to increase the output luminous flux of the light emitting apparatus 1300 when there are a great number of users acting in the area in which the illumination system is installed or to decrease the output luminous flux when motions of the users are reduced.

Meanwhile, the driving unit 1312 may generate the control signals not only based on each of the time information, the luminous flux information, the color temperature information, the temperature information, the humidity information and the motion information but also based on two or more of such information. By way of example, the control signals may be generated based on the outside color temperature and the time information or based on the outside temperature and the time information. Further, the control signals may be generated by using the respective information in the order of priority thereof. For example, the outside temperature may be assigned the highest priority and the largest weight may be given to the temperature information in controlling the magnitude of a driving voltage to be supplied to each light emitting portion.

Figure 12:
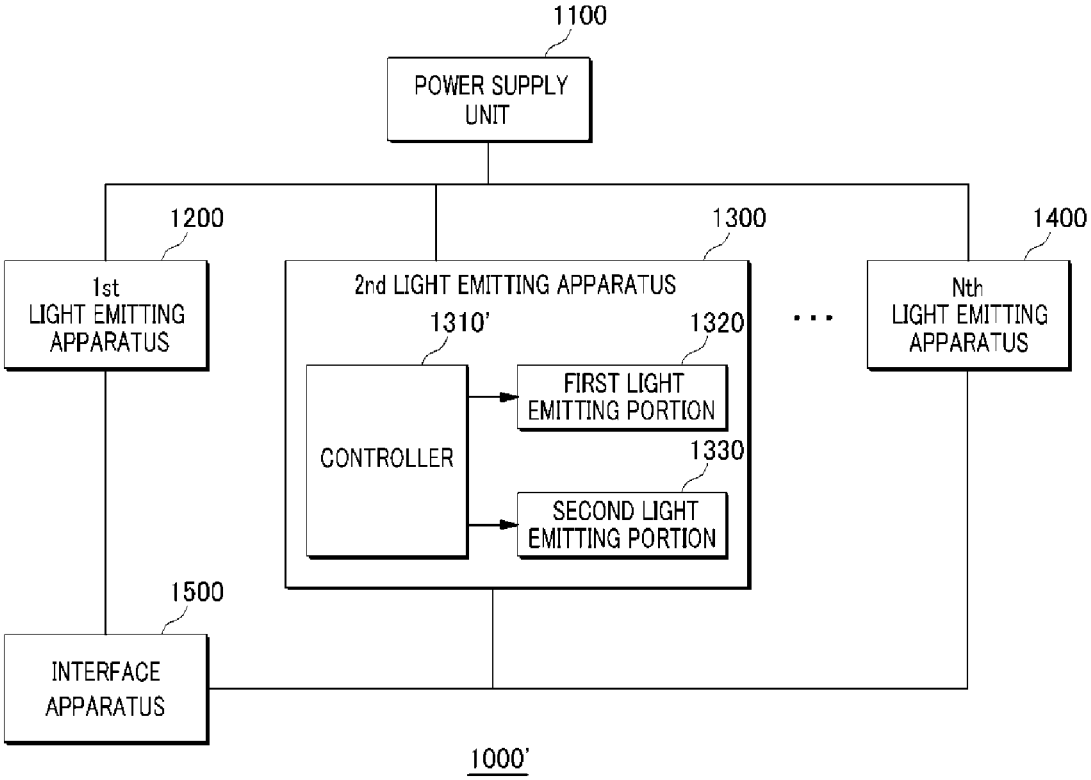
FIG. 12 is a diagram illustrating an illumination system in accordance with a fifth embodiment of the present invention.

FIG. 12 is a diagram illustrating an illumination system in accordance with a fifth embodiment of the present invention.

Figure 13:
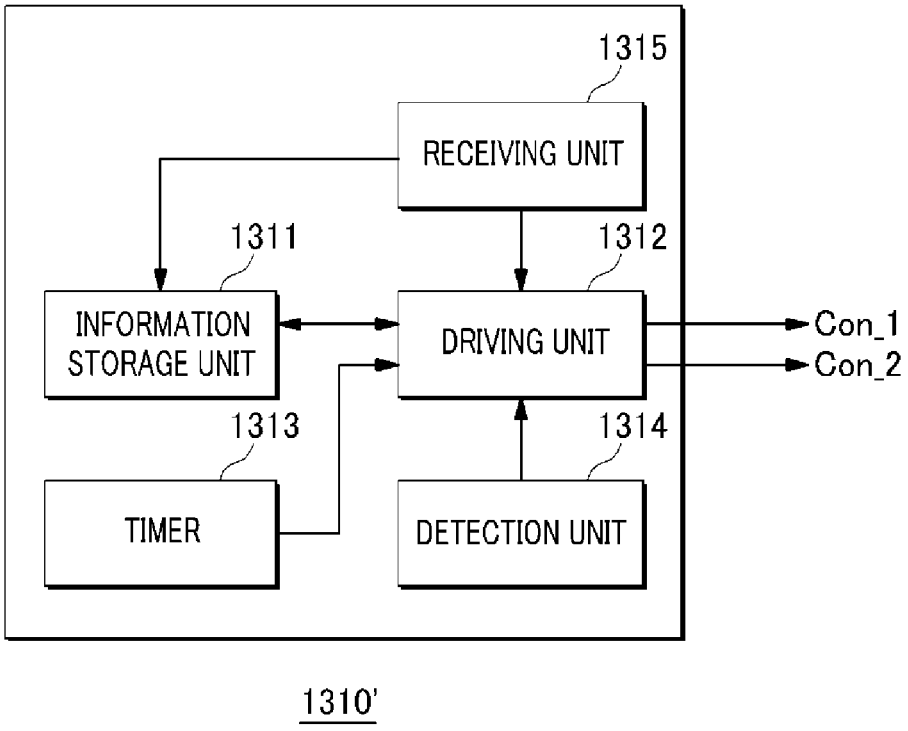
FIG. 13 is a diagram illustrating a detailed configuration of a controller included in the illumination system in accordance with the fifth embodiment of the present invention.

FIG. 13 is a diagram showing a detailed configuration of a controller included in the illumination system in accordance with the fifth embodiment.

An illumination system 1000' in accordance with the fifth embodiment may further include an interface apparatus 1500 in addition to the components of the illumination system of the fourth embodiment.

The interface apparatus 1500 may generate user data for adjusting an operation status of each light emitting apparatus in response to an input from the user. The interface apparatus 1500 may transmit the user data to the light emitting apparatuses 1200, 1300 and 1400 through wired or wireless communications. The interface apparatus 1500 may be provided for each of the light emitting apparatuses 1200, 1300 and 1400, or it may be also possible to transmit the user data to the light emitting apparatuses 1200, 1300 and 1400 through a common interface apparatus 1500.

Here, the user interface may include luminous flux control data or color temperature control data according to a luminous flux, a color temperature, a temperature, a humidity, time and/or motion information selected by the user. By way of example, the user may set a time range through the interface apparatus 1500 and designate a luminous flux and a color temperature to be outputted at the selected time range. In such a case, the information inputted by the user may be stored in the information storage unit 1311, and the driving unit 1312 may drive the respective light emitting portions 1320 and 1330 of the light emitting apparatus 1300 based on this newly stored information.

As illustrated in FIG. 13, in accordance with the fifth embodiment, a controller 1310' may further include a receiving unit 1315. The receiving unit 1315 may receive the user data sent from the interface apparatus 1500, and the information storage unit 1311 may additionally store the user data.

Figure 14:
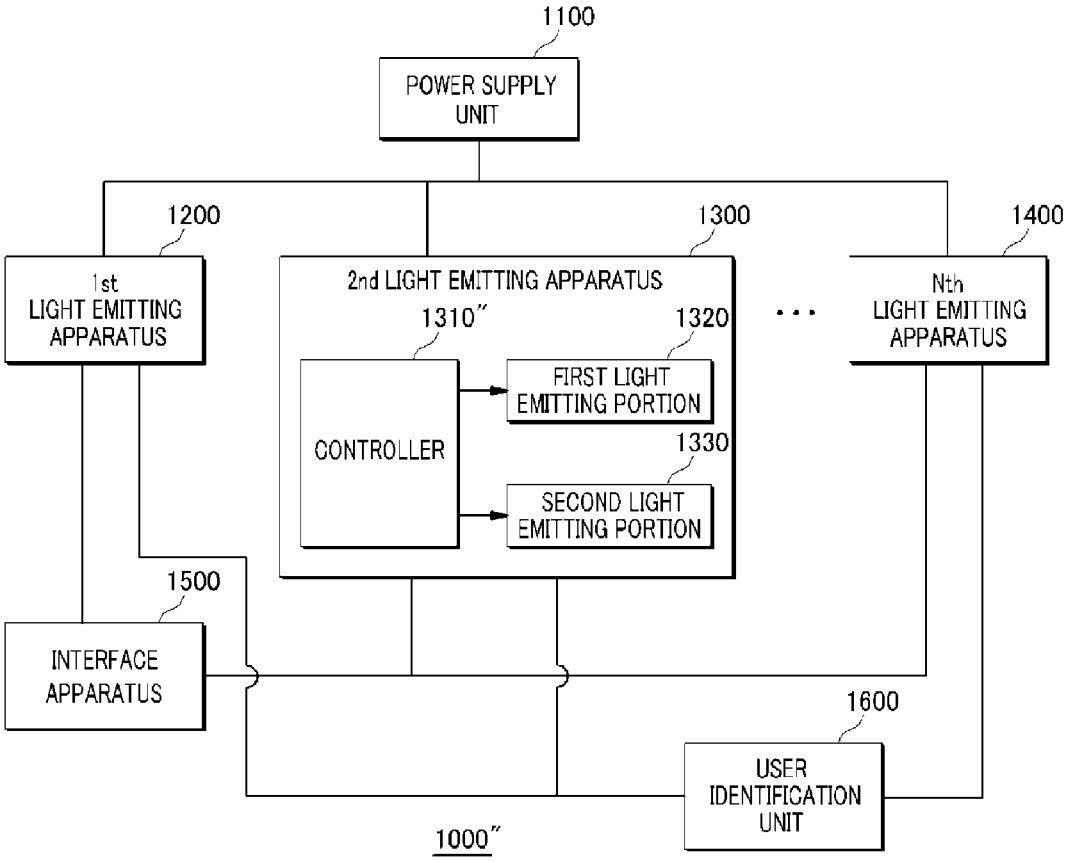
FIG. 14 is a diagram illustrating an illumination system in accordance with a sixth embodiment of the present invention.
Figure 15:
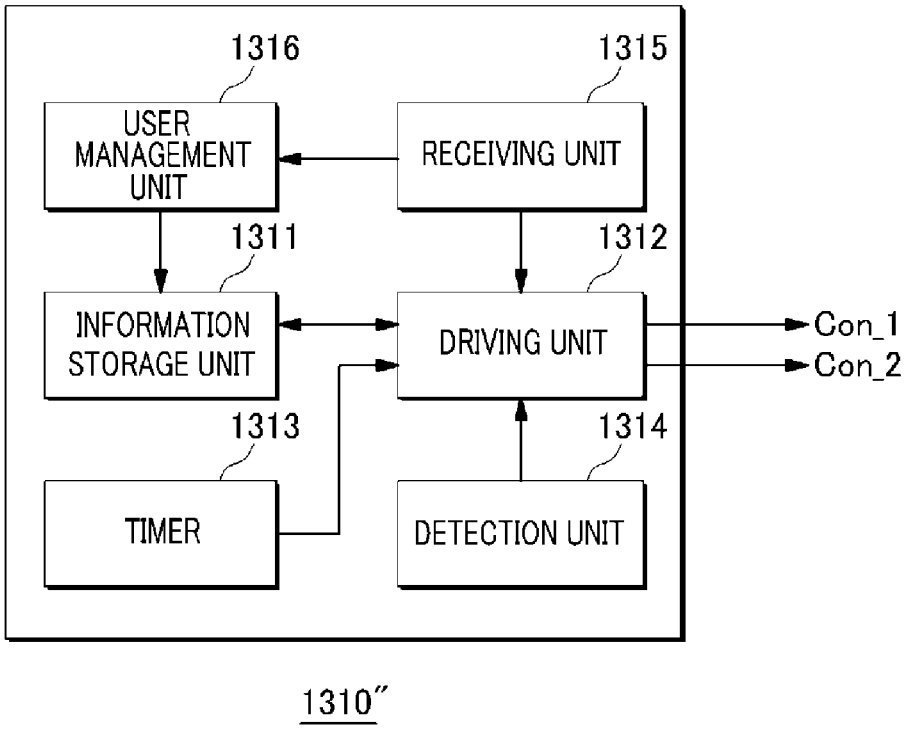
FIG. 15 is a diagram illustrating a detailed configuration of a controller included in the illumination system in accordance with the sixth embodiment of the present invention.

FIG. 14 is a diagram illustrating an illumination system in accordance with a sixth embodiment of the present invention. FIG. 15 is a diagram showing a detailed configuration of a controller included in the illumination system in accordance with the sixth embodiment.

An illumination system 1000" in accordance with the sixth embodiment may additionally include a user identification unit 1600.

The user identification unit 1600 may identify a user who comes in and out of the area in which the illumination system 1000 is installed. Like various types of security apparatuses for opening/closing a door by identifying a user, the user identification unit may identify an already registered user by using various means for identification, such as an ID card possessed by the user, fingerprint scan or iris scan. To be more specific, the user identification unit 1600 may compare previously stored user information with identification information obtained by the various types of identification devices and determines whether the user is registered or not. If it is found that the user is registered, the user identification unit 1600 sends the user identification information to the controller 1310.

Meanwhile, the user identification unit 1600 may perform a registration process for an unregistered user. That is, if the identified user is found to be an unregistered user, the user identification unit 1600 may guide the user through a user registration process. The newly inputted user information may be stored in a storage unit of the user identification unit 1600 and the information storage unit 1311 of the controller 1310".

Meanwhile, the user identification unit 1600 may send the user identification information to the light emitting apparatuses 1200, 1300 and 1400 through wired or wireless communications. The identification unit 1600 may be provided for each of the light emitting apparatuses 1200, 1300 and 1400, or it may be possible to use the common identification unit 1600.

Meanwhile, the user identification unit 1600 may be included in or combined with the interface apparatus 1500.

The user may input a desired illumination condition through the user interface apparatus 1500. That is, based on their own identification number, the user is capable of setting the luminous flux or the color temperature of the illumination system depending on time, an outside color temperature, an outside temperature, an outside humidity or outside motions.

In accordance with the sixth embodiment, the controller 1310" may further include a user management unit 1316, and an information storage unit 1311 may additionally store user information and user-based control data.

The controller 1310" controls the color temperature or the luminous flux of the output light by controlling an output luminous flux of the first light emitting portion 1320 or a color temperature of the second light emitting portion 1330 based on user-based luminous flux control data or user-based color temperature control data corresponding to user information identified by the user identification unit 1600.

In this exemplary embodiment, a receiving unit 1315 may additionally receive the user identification information sent from the user identification unit 1600 in addition to the user data sent from the interface apparatus 1500.

The user management unit 1316 may compare the received user identification information with the registered user information stored in the information storage unit 1311 and determine whether corresponding user-based control data is in the information storage unit 1311. If user-based control data for the identified user is in the information storage unit 1311, the user management unit 1316 sends the user-based control data to the driving unit 1312. The driving unit 1312 may generate a control signal based on the received user-based control data.

The information storage unit 1311 may further store therein the user-based control data in addition to the color temperature control data including the color temperature information or the luminous flux control data including the luminous flux information set based on the ambient environment information as mentioned above.

The user-based control data may include user-based color temperature control data or user-based luminous flux control data set by the user. By way of example, the user-based luminous flux control data may include luminous flux information differently set for each user depending on time, an outside luminous flux, an outside color temperature, an outside temperature, an outside humidity or an outside motion, and this user-based light control data may be stored in the information storage unit 1311. Further, the user-based color temperature control data may include color temperature information differently set for each user depending on time, an outside luminous flux, an outside color temperature, an outside temperature, an outside humidity or an outside motion, and this user-base color temperature control data may be stored in the information storage unit 1311.

The driving unit 1312 may control the output luminous flux of the first light emitting portion 1320 or the color temperature of the second light emitting portion 1330 based on the user-based luminous flux control data or the user-based color temperature control data.

In accordance with the above-described configuration, if a user for whom a user-based control data is registered in advance enters the area in which the illumination system 1000 is installed, an illumination state can be adjusted based on the registered user-based control data.

Figure 16:
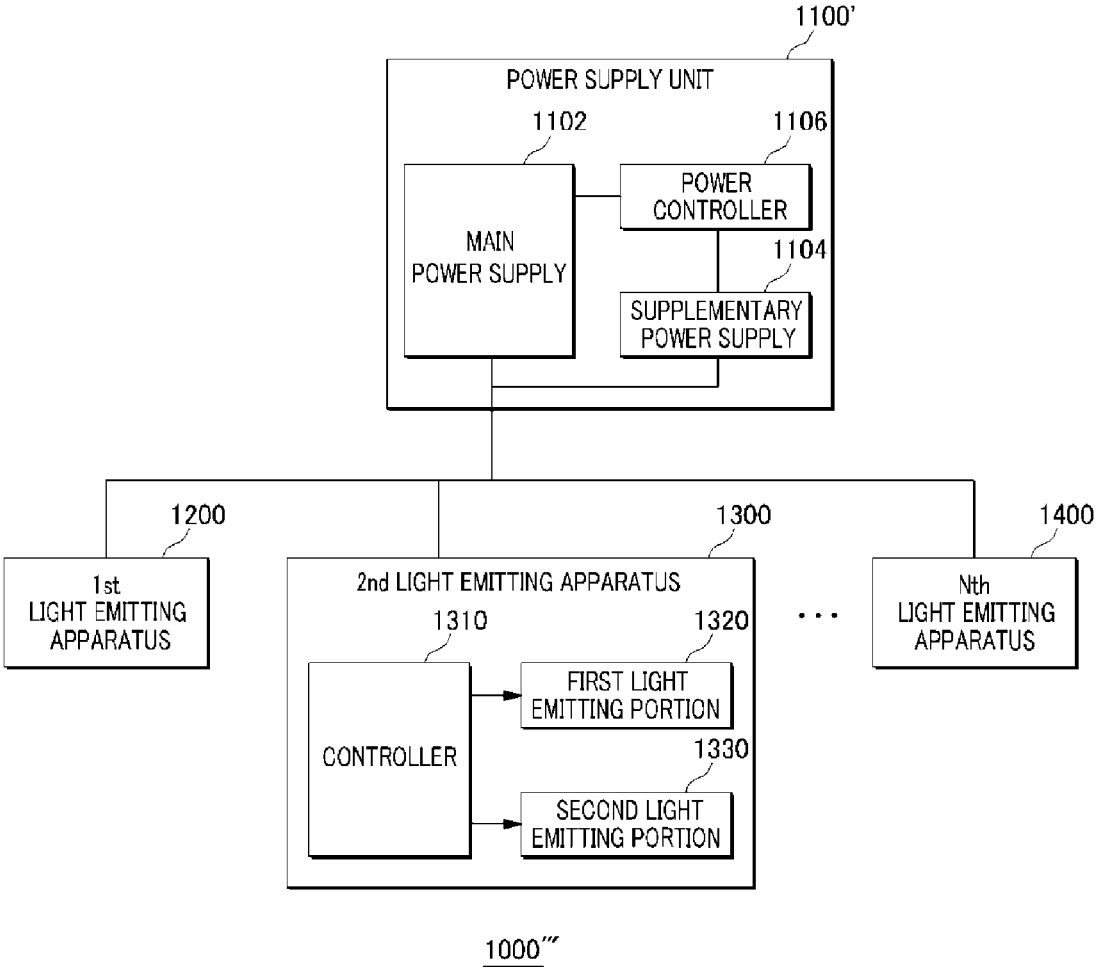
FIG. 16 is a diagram illustrating an illumination system in accordance with a seventh embodiment of the present invention.

FIG. 16 is a diagram illustrating an illumination system in accordance with a seventh embodiment of the present invention.

The seventh embodiment is different from the aforementioned embodiments in view of a configuration of a power supply unit 1100'. That is, in accordance with the seventh embodiment, power may be supplied to each light emitting apparatus from a supplementary power supply 1104 when a power supply from an external main power supply 1102 is cut due to a power failure or the like.

The power supply unit 1100' may include the main power supply 1102, the supplementary power supply 1104 and a power controller 1106.

The main power supply 1102 may be a power supply that supplies power from the outside. By way of non-limiting example, the main power supply 1102 may be a household or industrial AC power source.

The power controller 1106 may detect a power supply state of the main power supply 1102. When the power supply from the main power supply 1102 is cut, the power controller 1106 may control the supplementary power supply 1104 to supply power.

The supplementary power supply 1104 may be configured to independently supply power to each light emitting apparatus regardless of the power supply state of the main power supply 102. The supplementary power supply 1104 may be, but not limited to, a battery, a secondary battery, a power generator or a solar cell.

Figure 17:
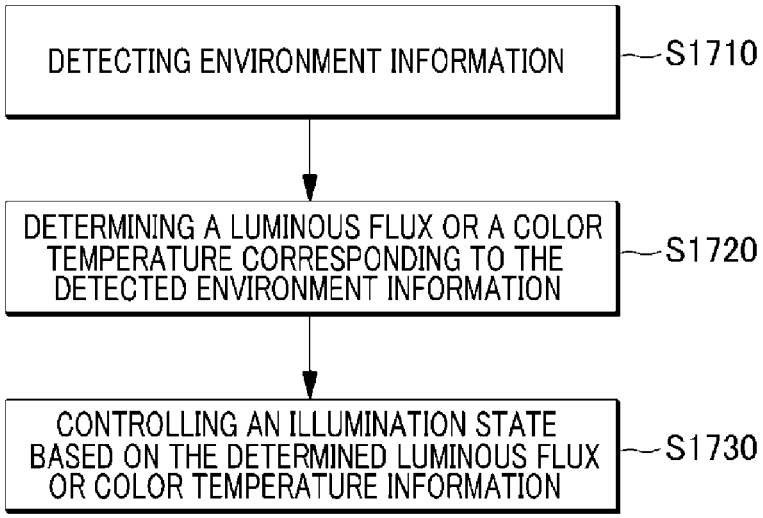
FIG. 17 is a flowchart for describing an illumination method using an illumination system in accordance with an embodiment of the present invention.

FIG. 17 is a flowchart for describing an illumination method using an illumination system in accordance with an embodiment of the present invention.

First, information upon environment outside the illumination system 1000 may be detected (S1710). By way of example, time, an outside luminous flux, an outside temperature, an outside humidity or an outside motion may be detected by the detection unit 1314. Additionally, entrance of a user, for whom user-based control data is previously registered in the illumination system 1000', may also be detected.

Then, a luminous flux or a color temperature corresponding to the detected environment information is determined (S1720). As discussed above, the information storage unit 1311 includes luminous flux control data or color temperature control data stored therein based on the time, the outside luminous flux, the outside color temperature, the outside temperature, the outside humidity or the outside motion information. Moreover, the information storage unit 1311 also stores user-based control data. The driving unit 1312 may determine luminous flux or color temperature information based on various types of control data stored in the information storage unit 1311 in order to set the luminous flux or color temperature corresponding to the detected environment information.

Afterward, an illumination state is controlled based on the determined luminous flux or color temperature information (S1730). That is, a first control signal to control the first light emitting portion 1320 or a second control signal to control the second light emitting portion 1320 is generated based on the luminous flux control data or the color temperature control data. Each light emitting portion is driven based on each control signal, and the luminous flux or color temperature of the light emitting apparatus 1300 is determined according to the luminous flux or color temperature outputted from each light emitting portion.

The above description of the present invention is provided for the purpose of illustration, and it would be understood by those skilled in the art that various changes and modifications may be made without changing technical conception and essential features of the present invention. Thus, it is clear that the above-described embodiments are illustrative in all aspects and do not limit the present invention. For example, each component described to be of a single type can be implemented in a distributed manner. Likewise, components described to be distributed can be implemented in a combined manner.

The scope of the present invention is defined by the following claims rather than by the detailed description of the embodiment. It shall be understood that all modifications and embodiments conceived from the meaning and scope of the claims and their equivalents are included in the scope of the present invention.

What is claimed is:

1. An illumination system, comprising:

a power supply unit; and a light emitting apparatus driven by power supplied from the power supply unit, wherein the light emitting apparatus comprises:

a first light emitting portion and a second light emitting portion disposed in a same light emitting package and configured to be independently driven to emit output light; and a controller configured to control at least one of a color temperature and a luminous flux of the output light by controlling operations of the first and second light emitting portions, and wherein the controller is configured to generate a first control signal based on luminous flux control data and a second control signal based on color temperature control data, and the controller is configured to output the first control signal to control an output luminous flux of the first light emitting portion and output the second control signal to control a color temperature of the second light emitting portion.

2. The illumination system of claim 1, wherein the power supply unit comprises:

a main power supply to provide main power;

a supplementary power supply configured to supply supplementary power; and a power supply controller configured to detect whether the main power from the main power supply is cut and supply the supplementary power to the light emitting apparatus from the supplementary power supply when the power supply from the main power supply is cut.

3. The illumination system of claim 1, wherein the controller comprises:

an information storage unit configured to store in advance therein control data comprising at least one of time based luminous flux control data, time based color temperature control data, ambient luminous flux based luminous flux control data, ambient luminous flux based color temperature control data, ambient color temperature based luminous flux control data, ambient color temperature based color temperature control data, ambient temperature based luminous flux control data, ambient temperature based color temperature control data, ambient humidity based luminous flux control data, ambient humidity based color temperature control data, ambient motion based luminous flux control data and ambient motion based color temperature control data;

a detection unit configured to detect at least one of ambient luminous flux information, ambient color temperature information, ambient temperature information, ambient humidity information, and ambient motion information; and a driving unit configured to generate at least one of the first control signal to control the operation of the first light emitting portion and the second control signal to control the operation of the second light emitting portion based on at least one of time information collected by a timer and the ambient luminous flux information, the ambient color temperature information, the ambient temperature information, the ambient humidity information, the ambient motion information detected by the detection unit, and at least one of the control data stored in the information storage unit.

4. The illumination system of claim 3, wherein the detection unit comprises:

at least one of a temperature sensor for detecting an outside temperature, a light sensor for detecting at least one of an outside luminous flux and an outside color temperature, and a motion sensor for detecting an outside motion.

5. The illumination system of claim 4, further comprising:

an interface apparatus configured to receive a user's control input signal for the light emitting apparatus and send the received user's control input signal to the controller, wherein the controller is configured to modify at least one of the control data stored in the information storage unit based on the control input signal received through the interface apparatus, and the controller is configured to control the at least one of the color temperature and the luminous flux of the output light based on the modified control data.

6. The illumination system of claim 5, wherein the controller is configured to control the at least one of the color temperature and the luminous flux of the output light based on the control input signal received through the interface apparatus.

7. An illumination system, comprising:

a power supply unit;

a light emitting apparatus driven by a power supplied from the power supply unit; and a user identification unit configured to identify a user;

wherein the light emitting apparatus comprises:

a first light emitting portion and a second light emitting portion disposed in a same light emitting package and configured to be independently driven to emit output light; and a controller configured to control at least one of a color temperature and a luminous flux of the output light by controlling operations of the first and second light emitting portions, and wherein the controller generates a first control signal based on luminous flux control data and a second control signal based on color temperature control data, and the controller outputs at least one of the first control signal to control an output luminous flux of the first light emitting portion and outputs the second control signal to control a color temperature of the second light emitting portion.

8. The illumination system of claim 7, wherein the power supply unit comprises:

a main power supply to provide main power;

a supplementary power supply configured to supply supplementary power; and a power supply controller configured to detect whether the main power from the main power supply is cut and supply the supplementary power to the light emitting apparatus from the supplementary power supply when the power supply from the main power supply is cut.

9. The illumination system of claim 7, wherein the controller comprises:

an information storage unit to store in advance therein luminous flux control data comprising luminous flux information differently set for each user depending on at least one of time, an outside luminous flux, an outside color temperature, an outside temperature, an outside humidity, and an outside motion or color temperature control data comprising color temperature information differently set for each user depending on at least one of time, an outside luminous flux, an outside color temperature, an outside temperature, an outside humidity, and an outside motion;

a detection unit configured to detect at least one of outside luminous flux information, outside color temperature information, outside temperature information, outside humidity information, and outside motion information; and a driving unit configured to generate at least one of the first control signal to control the operation of the first light emitting portion and the second control signal to control the operation of the second light emitting portion based on at least one of the user information identified by the user identification unit, time information collected by a timer and the outside luminous flux information, the outside color temperature information, the outside temperature information, the outside humidity information, and the outside motion information detected by the detection unit, and at least one of the control data stored in the information storage unit.

10. The illumination system of claim 9, further comprising:

an interface apparatus configured to receive a user's control input signal for each light emitting apparatus and send the received user's control input signal to the controller of each light emitting apparatus, wherein the controller is configured to modify the at least one of the control data stored in the information storage unit based on the control input signal received through the interface apparatus, and the controller is configured to control the at least one of color temperature and the luminous flux of the output light based on the modified control data.

11. The illumination system of claim 10, wherein the controller is configured to control the at least one of the color temperature and the luminous flux of the output light based on the control input signal received through the interface apparatus.

12. A method for controlling illumination system, the method comprising:

storing environment-related control data in an information storage unit;

detecting ambient information outside the illumination system;

determining at least one of a luminous flux and a color temperature for the illumination system based on the environment-related control data and the ambient information;

controlling a first light emitting portion and a second light emitting portion based on the at least one of the luminous flux and the color temperature;

generating a first control signal based on luminous flux control data;

generating a second control signal based on color temperature control data;

outputting the first control signal to control an output luminous flux of the first light emitting portion; and outputting the second control signal to control a color temperature of the second light emitting portion, and wherein the first light emitting portion and the second light emitting portion are disposed in a same light emitting package and independently driven to emit output light.

13. The method of claim 12, wherein the detecting ambient information comprises detecting at least one of an outside luminous flux, an outside temperature, an outside humidity, and an outside motion.

* * * * *